US006253431B1

(12) United States Patent
Ames et al.

(10) Patent No.: US 6,253,431 B1
(45) Date of Patent: Jul. 3, 2001

(54) AIR OPENING JET APPARATUS

(75) Inventors: Todd Ames, York, SC (US); William West, Charlotte, NC (US); Ricky Kenley, Radford, VA (US); William T. Wygand; Edward J. Powers, both of Charlotte, NC (US)

(73) Assignee: Celanese Acetate LLC, Charlotte, NC (US)

( * ) Notice: Subject to any disclaimer, the term of this patent is extended or adjusted under 35 U.S.C. 154(b) by 0 days.

(21) Appl. No.: 09/426,268

(22) Filed: Oct. 25, 1999

(51) Int. Cl.[7] ..... D01D 11/02; D02J 1/18

(52) U.S. Cl. ..... 28/283; 28/221; 28/267; 19/66 T

(58) Field of Search ..... 28/283, 282, 281, 28/220, 221, 262, 263, 264, 265, 267, 271, 273, 274, 276, 248; 19/66 T, 66 R; 493/44, 50, 48

(56) References Cited

U.S. PATENT DOCUMENTS

| | | | |
|---|---|---|---|
| 2,794,480 | 6/1957 | Crawford . | |
| 2,908,045 | 10/1959 | Stevens | 19/66 |
| 3,017,309 | 1/1962 | Crawford et al. | 156/161 |
| 3,032,829 | 5/1962 | Mahoney . | |
| 3,050,430 | 8/1962 | Gallagher | 156/166 |
| 3,079,663 | 3/1963 | Dyer . | |
| 3,081,951 | 3/1963 | Dyer et al. | 239/455 |
| 3,095,343 | 6/1963 | Berger . | |
| 3,099,594 | 7/1963 | Caines . | |
| 3,156,016 | 11/1964 | Dunlap et al. | 19/66 |
| 3,226,773 | 1/1966 | Paliyenko | 19/66 |
| 3,258,823 | 7/1966 | Stevens et al. | 28/1 |
| 3,262,178 | 7/1966 | Aspy . | |
| 3,262,181 | 7/1966 | Hawkins . | |
| 3,281,913 | 11/1966 | Morehead . | |
| 3,282,768 | 11/1966 | Caines . | |
| 3,297,506 | 1/1967 | Pannill . | |
| 3,402,446 | 9/1968 | Benson | 28/1 |
| 3,413,698 | 12/1968 | Fritz et al. | 28/1 |
| 3,525,134 | 8/1970 | Coon . | |
| 3,535,745 * | 10/1970 | Zeidman | 28/283 |
| 3,645,431 | 2/1972 | Harrison . | |
| 3,730,824 * | 5/1973 | Watson | 28/283 |
| 3,745,617 | 7/1973 | Smith . | |
| 3,766,606 * | 10/1973 | Piper et al. | 28/283 |
| 3,795,944 * | 3/1974 | Daniels | 28/283 |
| 3,805,343 | 4/1974 | Ethridge . | |
| 3,831,501 | 8/1974 | Bevington, Jr. | 93/1 |
| 3,960,645 | 6/1976 | Brackmann et al. | 156/441 |
| 4,259,769 * | 4/1981 | Greve et al. | 28/283 |
| 4,435,239 | 3/1984 | Harris . | |
| 4,468,845 | 9/1984 | Harris . | |
| 4,472,224 | 9/1984 | Pryor . | |
| 4,522,616 | 6/1985 | Hyde . | |
| 4,541,825 | 9/1985 | Hyde et al. | 493/44 |
| 5,060,351 | 10/1991 | Street . | |
| 5,203,757 | 4/1993 | Kampen . | |
| 5,282,779 * | 2/1994 | Sakai et al. | 28/283 |
| 5,331,976 | 7/1994 | St. Pierre . | |
| 5,579,566 | 12/1996 | Burkhardt . | |
| 5,591,297 | 1/1997 | Ahr . | |

FOREIGN PATENT DOCUMENTS

| | | |
|---|---|---|
| 7-49611 | 3/1984 | (JP) . |
| WO 83/03267 | 9/1983 | (WO) . |

* cited by examiner

*Primary Examiner*—Amy B. Vanatta
(74) *Attorney, Agent, or Firm*—Kennedy Covington Lobdell & Hickman, LLP

(57) ABSTRACT

The invention provides an air opening jet for use in a process for making a rectangular structure made from a tow of fibers, such air opening jet including a housing, an air jet for moving the tow through the housing and opening the tow, and an accumulating chamber that includes at least one, and preferably two, perforated plates located in the path of the moving tow, and an air control arrangement for controlling the flow of air so that the moving tow is urged into engagement with the perforated plates to retard movement of the tow and cause it to properly accumulate in the accumulation chamber.

5 Claims, 7 Drawing Sheets

AIR OPENING JET APPARATUS

FIELD OF THE INVENTION

This invention relates to systems which can be used to open a tow of fibers such that the resulting "opened tow" of fibers has a shape useful in the production of absorbent structures, and more particularly to an air opening jet apparatus for use in such systems.

BACKGROUND OF THE INVENTION

Many types of filaments, fibers and yarn (collectively "fibers") are sold as a "tow" in which a plurality of such fibers are compressed together, optionally with crimping, by methods known to those skilled in the art in order to maximize the content of the packing systems, for example, bales, by which such tows are sold and delivered to users of tow. Before use, such users generally "open" such tow, separating the compressed fibers by a distance greater than that in the compressed state. Numerous methods and devices for opening tows are known and described in the art. Examples include U.S. Pat. Nos. 3,282,768, 3,099,594, 4,522,616, 2,794,480, 3,032,829, 5,591,297 and 5,203,757 whose teachings are incorporated herein by reference. While such devices have found utility in various applications, such devices typically produce "opened" tows which were substantially circular in cross-section, for example, tows used to make smoke filters or writing instrument reservoirs. However, for other applications a rectangular shape is preferred; for example, absorbent structures which are intended for use in personal care products such as diapers, bandages, hygiene pads and similar absorbent products. For such uses a shape that has a substantially rectangular cross-section is preferred.

It is also known to use, in systems of the foregoing types, air jets which open the tow and form it into a rectangular shape for use in tobacco filter rods and the like, as disclosed in U.S. Pat. Nos. 4,468,845 and 4,435,239. One of the significant advantages asserted for these systems is the fact that the air opening jet employed in the system is designed to operate at very low air pressures (e.g. less than 3 psi), which is said to eliminate the need for the large capital investment in expensive air compressing and piping facilities normally associated with air opening or "blooming" systems. This low pressure air is utilized to move the tow through the air opening jet, during which the tow is opened, and then through a bustle assembly in which the opened tow is decelerated and retarded in the bustle assembly to obtain the desired opening and density of the tow. This deceleration and retarding of the tow is obtained by an adjustable tension arrangement for engaging the tow, and more particularly by a flat, imperforate "tension" plate that is pivotally mounted at one of its ends within the bustle assembly, and a relatively complex mechanical arrangement for adjusting the movement of the pivoted tension plate toward and away from the tow to thereby vary the tension force applied to the tow by the tension plate.

SUMMARY OF THE INVENTION

In accordance with the present invention, an air opening jet apparatus is provided for use in a system for opening a thin, relatively wide tow of textile filaments held together by crimping and forming the opened tow into a predetermined shape suitable for use as an absorbent structure for personal care products. The air opening jet apparatus includes a housing having an inlet opening for receiving a partially opened tow and having a configuration corresponding generally to the shape of the partially opened tow. The housing also has an outlet opening through which the tow exits the housing and this outlet opening has configuration corresponding generally to the predetermined shape.

An air jet is formed within the housing adjacent the inlet opening thereof to create a venturi which moves the tow through the air opening jet apparatus and which also further opens the tow, and a source of compressed air communicates with the air jet to provide carrier air for moving the tow through the air opening jet apparatus.

A forming chamber is provided within the housing and downstream of the air jet that includes a gradually increasing cross-sectional area in the direction of flow of the tow that corresponds to the predetermined shape, the airjet being disposed within the housing to cause the tow to be fully opened and to substantially fill the forming chamber as it moves therethrough.

An accumulating chamber is located within the housing downstream of the forming chamber that is constructed and arranged to permit the opened tow to accumulate within the accumulating chamber and be withdrawn from the housing at different flow rates through the housing outlet opening in the predetermined shape. The accumulating chamber includes at least one perforated plate disposed in the path of the tow and the carrier air moving therethrough to cause the tow to engage the perforated plate and to cause at least some of the carrier air to pass through the perforated plate.

A control valve is provided for maintaining the flow of the carrier air at a level that will cause at least the portion of the carrier air to pass through the perforated plate and urge the tow into frictional engagement with the perforated plate with sufficient force to retard the movement of the tow through the accumulating chamber and cause the tow to accumulate in the accumulating chamber.

In the preferred embodiment of the present invention, the accumulating chamber may include a second perforated plate located in spaced relation to the first above mentioned perforated plate, and the tow moves between the perforated plates and is urged into engagement therewith by the carrier air passing through both the perforated plates. Finally, in the preferred embodiment of the present invention, the predetermined shape of the outlet opening in the housing is rectangular.

DETAILED DESCRIPTION OF THE INVENTION

Figure 1:
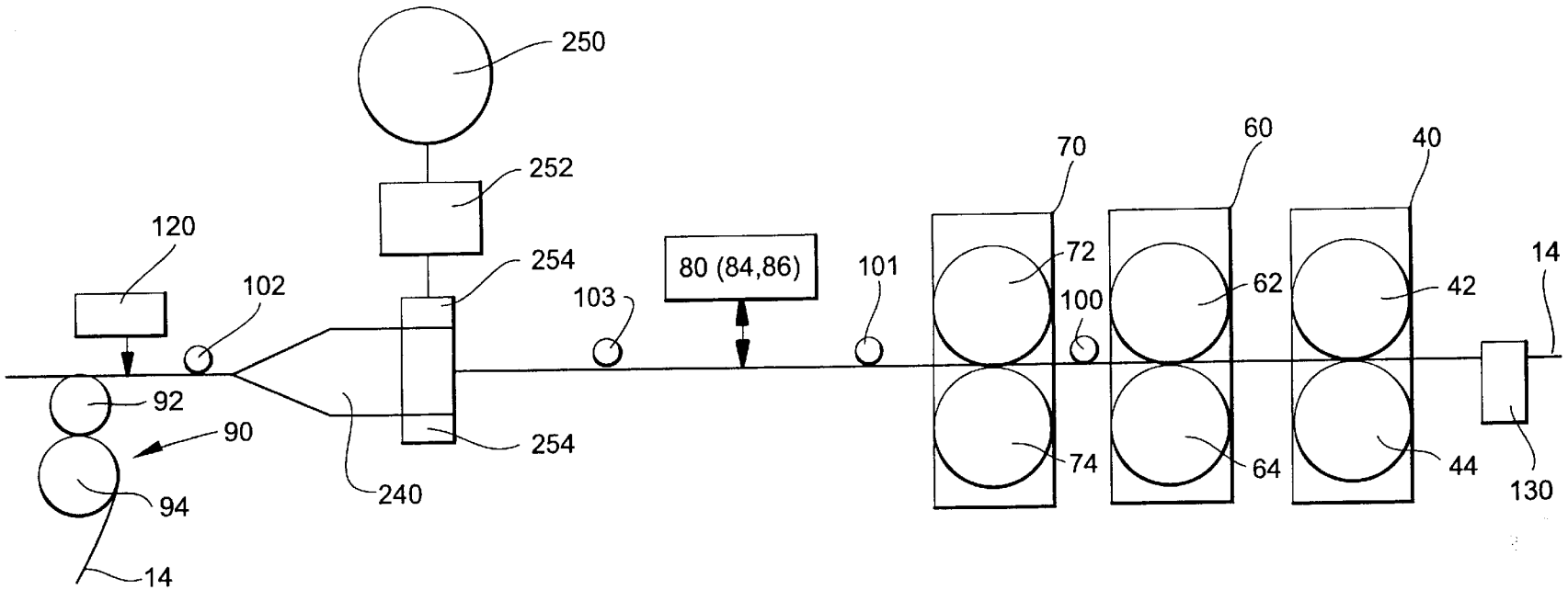
FIG. 1 is a diagrammatic illustration of a typical tow opening system of the type in which the air opening jet of the present invention may be used.
Figure 2:
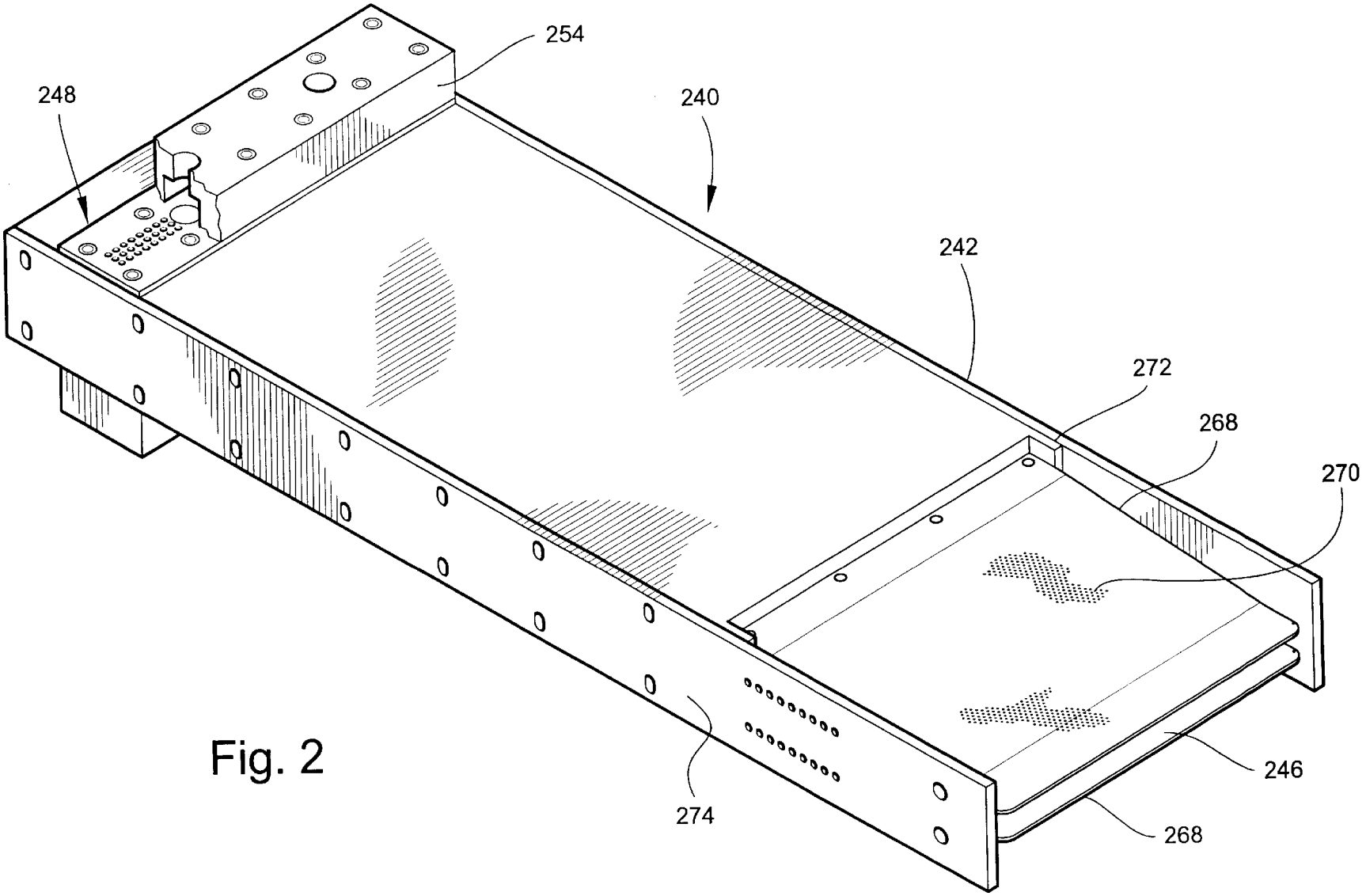
FIG. 2 is a perspective view of a preferred embodiment of the air opening jet of the present invention.

The term "fiber" as used herein means a filament, fiber or yarn of any material whatsoever; for example, cellulose acetate and triacetate, polyester, polyamide, polyolefin and similar polymeric substances.

The term "tow" as used herein means a plurality of fibers compressed together, optionally with "crimping" as such term is used and understood in art, by methods known to those skilled in the art in order to maximize the content of packaging systems by which such tows are sold and delivered, or to facilitate the transport of such plurality of fibers from one point to another point, for example, within a manufacturing facility.

The terms "rectangular" and "substantially rectangular" as used herein, are to be understood as meaning a structure have a generally rectangular cross-section with possible slight defects, for example, rounded corners and a slight bowing or indentation along a side.

The fibers comprising the tow may be made from any natural or synthetic substance, or mixture and/or blends thereof, including polyesters, polyamides, cellulose acetate and triacetate (collectively, an "acetate" tow), polypropylene oxide, polyethylene sulfide, liquid crystalline polymeric substances capable of being formed into fibers, polyamides, silk, wool, cotton, rayon, polyolefins, polyacrylates, polymethacrylates, and similar substances which can be made into fibers. Such fibers may or may not have a "finish" applied to them, depending upon their application. Generally, an external finish is applied to such fibers so as to facilitate transport, although "internal" finishes, contained in the material used to form the fiber, may also be used and such fibers are included within the scope of the invention. In addition, the fibers of the tow may be of any denier, tex, diameter or other cross-sectional or cross-section related size designation suitable for producing tow.

The terms "banding jet" and "air banding jet" are used to signify a first tow opening device which utilizes air to spread a tow in a direction perpendicular to the direction of travel. The "banding jet" is different and distinct from the "opening jet" or "air opening jet" also described herein.

While the present invention may have a wide variety of tow opening applications, it has been found to be particularly useful in opening a tow made of acetate fibers, polyester fibers, polyolefin fibers and polyamide fibers, and mixtures thereof. For example, an acetate tow may consist of about 2,500 to about 25,000 fibers having an individual denier of from about 1 to about 10, preferably of from about 3 to about 6. The total denier for the entire tow, that is the assemblage of from about 2,500 to about 25,000 fibers, is thus from about 2,500 to about 250,000. Acetate tows are generally of about 10,000 to about 20,000 fibers of individual denier of about 3 to about 6, giving rise to a tow having a total denier of about 30,000 to about 120,000.

The fibers of a tow should be uniformly or substantially uniformly distributed across the width/cross-section of the crimped tow bundle or band. This uniform fiber distribution is important to the process of opening a tow into a rectangular or substantially rectangular shape, and the more nearly uniform distribution of fibers the easier it will be to produce a rectangular or substantially rectangular opened tow. Crimped and baled tows having a variety of width/cross-sections may be used in accordance with the invention, for example, about 25 mm (millimeters) to about 75 mm in width, preferably from about 40 mm to about 60 mm, and from about 1 mm to about 7 mm in height or thickness, preferably from about 2 to about 5 mm, with typical the dimensions being about 50 mm wide and about 3 mm thick.

As previously mentioned, an external finish may be applied to each fiber in a tow, such finish being in an amount from about 0.3% to about 5% by weight of the fiber bundle, preferably from about 0.5% to about 2.0%.

The tows used in practicing the invention are generally "crimped tows" as the term is used and known to those skilled in the art. Crimping is done at about 5 to about 30 crimps per inch of uncrimped tow, preferably of from about 20 to about 25 crimps per inch of uncrimped tow.

While it is to be understood that the present invention may have applications in a variety of tow opening systems, one typical system in which the present invention finds particular application is illustrated diagrammatically in FIG. 1. A tow 14 may initially be fed through a conventional set of guides (not shown) to flatten and orient the tow 14. The tow is then fed to a banding jet 130 of conventional design. The banding jet evenly spreads the tow band in the direction perpendicular to the tow processing direction. Generally, the air banding jet 130 used in these preferred embodiments can be any air banding jet known in the art, for example, as described in U.S. Pat. No. 3,226,773, or in co-pending U.S. patent application Ser. No. 09/219,818, filed Dec. 23, 1998, whose teachings are incorporated herein by reference. The tow 14 is then fed to a pre-tension roller assembly 40 and is compressed between metal roller 42 and rubber roller 44 of tension roller assembly 40 so as to stretch the tow and deregister and separate the tow fibers. Within tension roller assembly 40, roller pressure, the force applied to the tow by the rollers 42 and 44, is from about 1 to about 25 psi, preferably from about 5 to about 15 psi. Within device 40 as illustrated in FIG. 1, the metal roller is element 42 (top roller) and the rubber roller is 44 (bottom roller).

After emerging from assembly 40, the tow is fed to roller assembly 60 comprising a driver metal roller 62 and a rubber roller 64, said metal roller 62 having circular grooves or threaded or being a flat metal roller. During its traverse from assembly 40 to assembly 60, the tow is stretched, the stretching being accomplished by the drag associated with the nip pressure between rolls 42 and 44. The nip pressure between the rollers of assembly 60 is from about 1 to about 40 psi, preferably from about 20 to about 30 psi.

After emerging from assembly 60, tow 14 is passed by an optional first static eliminating bar 100 to remove any static charge which might be present on tow 14 and which might interfere with subsequent operations necessary in the formation of an absorbent structure.

After emerging from assembly 60, the tow is fed to roller assembly 70 comprising a driven metal roller 72 and a rubber roller 74, said metal roller 72 having circular grooves, or threaded, or being a flat metal roller. During its traverse from assembly 60 to assembly 70, the tow is stretched, the stretching being accomplished by driving the metal roller 72 at a rotational speed faster than driven roll 62. The rotational speed of roll 72 is between 20–60 percent faster than roll 62, preferably 30–50 percent. Each of the roller assemblies 40, 60 & 70, are conventional and well known; they include an arrangement for applying a pressure on one of the rolls in the assembly to urge the two rolls in the assembly into engagement with one another at a predetermined pressure level. These conventional assemblies may apply the pressure pneumatically, hydraulically or electrically, but pneumatic control is preferred.

The nip pressure between the rollers of assembly 70 is from about 1 to about 40 psi, preferably from about 20 to about 30 psi.

The tow emerging from assembly 70 is referred to hereafter as tow 14. The grooves or threads of roller 64 and 74 are of a design or orientation known to those skilled in the art of tow processing or opening. The fibers which emerge from assembly 70 are substantially deregistered or opened, suitable for further opening or forming into a lofty rectangular structure.

Substantial deregistration or blooming means that 90% or more, preferably 95% or more, of the fibers constituting the rectangular structure or rectangular tow are spaced apart by a distance greater than the distance between the fibers when the tow 14 was removed from bale 12.

After emerging from assembly 70, tow 14 is passed by an optional static eliminating bar 101 to remove any static charge which might be present on tow 14 and which might interfere with subsequent operations necessary in the formation of an absorbent structure.

After anti-static treatment, tow 14 is transported to an optional liquid additive assembly 80 which includes a liquid holding tank, a metering pump 84 and liquid dispenser applicators 86 within assembly 80 for dispersing liquids onto tow 14. The liquid dispersal applicators 86 may be spray nozzles, disk applicators, rotating brush applicators, wick contact rolls and similar devices of conventional design known to those skilled in the art. Liquids which can be dispersed onto tow 14 include water; hydrophilic liquids such as alcohols, glycols, dimethyl sulfide, ketones, ethers and similar substances; plasticizers such as Fiberset 100 or Fiberset 200 (Henkel Corporation, Cincinnati, Ohio); surfactants; and solutions containing plasticizers, surfactants and similar substances known to those skilled in the art. The liquid or solutions can be applied to either or both sides of tow 14 as it passes through assembly 86, and additionally can be applied in specific patterns of multiple liquids to create unique effects for transferring or storing liquids in an absorbent composite structure in which the rectangular tow 14 is included.

After emerging from the air opening jet 240, the tow 14 is delivered to optional assembly 120 where solid substances, for example, superabsorbent polymers (SAP), glues, adhesives, fragrances, wood pulp, deodorizers, antimicrobial agents and similar substances can be applied to tow 14 by equipment such as a streamout feeder fabricated by Solids Flow, Inc. of Fort Mill, S.C. For example, in the preparation of diapers containing SAP, the SAP may be delivered as a powder or a slurry vertically downwards on to tow 14. The low density, open, rectangular tow band structure exiting air jet 240 permits particles of solids to evenly distribute within the tow fiber structure. The fiber structure with evenly distributed solid particles can quickly be delivered to a subsequent process so that solid particle containment is achieved. Liquid addition from assembly 80 also enhances solids containment.

After the addition of solid substances by assembly 120, tow 14 is delivered to an optional speed delivery assembly 90 comprising, among other things, a driven roller 92 and a roller 94, either or both of which may have a rubber or metal surface for contact with tow 14. Driven roller 92 controls the overall operation of the process and the speed of the tow 14 as it is delivered to another process such as a diaper or absorbent composite forming machine. In general, driven roller 92 and driven roller 72 are operated at speeds such that the surface speed ratio (72/92) is from about 1.0 to about 3.0, preferably 1.8 to 2.2.

The linear speed of roll 92 is typically controlled by the line speed of a diaper or absorbent composite forming process to which the lofty rectangular tow structure is being fed.

In the preferred embodiment tow 14 is delivered directly to a diaper or absorbent composite forming process without the use of delivery speed assembly 90. In this embodiment the diaper or absorbent composite process acts as the delivery or takeaway speed control. The tow band structure with solids and applied liquids is nipped between rollers or wrapped around a driven single roller and pulled away from the air jet 240. Tissues or other webs can be introduced to encapsulate the fiber solids structure.

Additional optional static eliminating bars, elements 102 and 103, may be positioned between the air opening jet 240 and the liquids addition assembly 80, and after the air opening jet 240. Static eliminating bars 100, 101, 102, and 103 can facilitate controlling the processability of tow 14 by limiting static electricity and controlling the shape of the rectangular structure of tow 14. Additional static eliminating bars may be employed as required and are recommended when the moisture content in the environment is low. Such additional anti-static bars may not only be located after assemblies 60, 70 and 80, but also between assemblies 60 and 40, 40 and 130, and 120 and 90. Preferred embodiments have at least static eliminating bars 100, 101, and 102.

Figure 5:
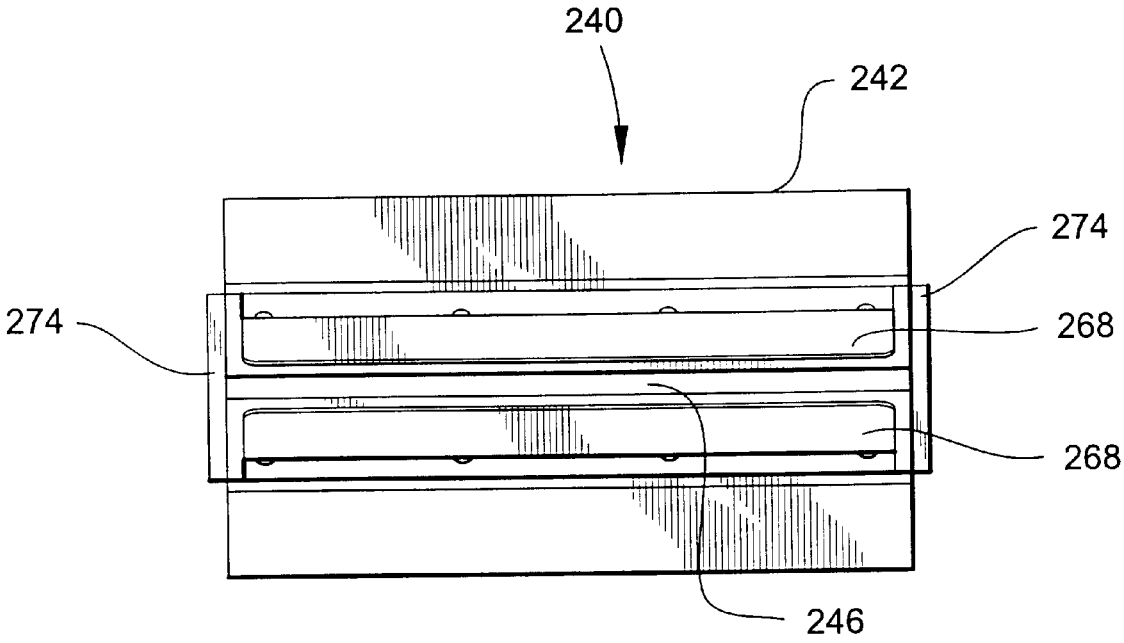
FIG. 5 is an elevation view illustrating the outlet opening in the housing.
Figure 6:
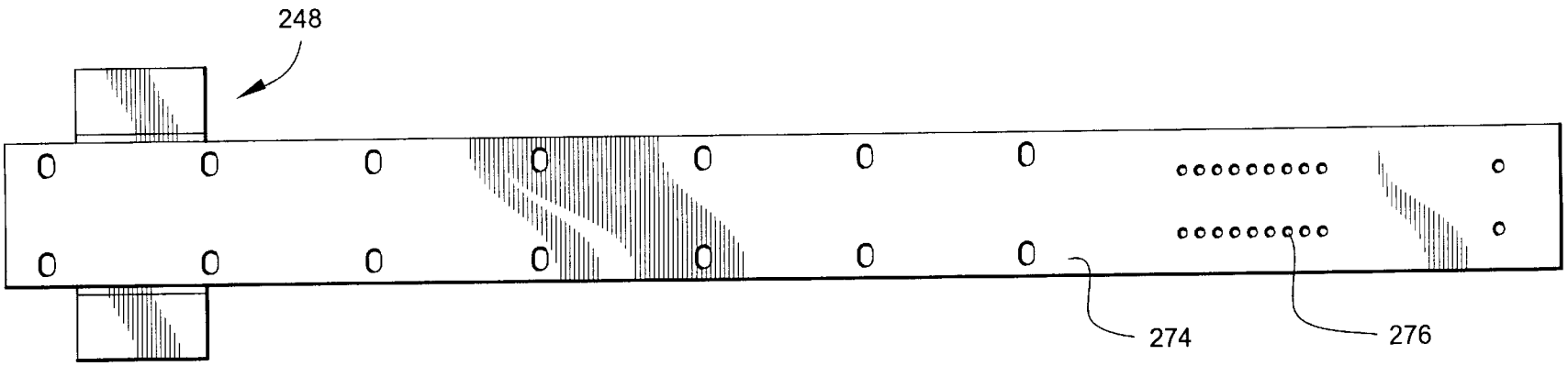
FIG. 6 is an elevation view of one of the side plates of the housing.
Figure 7:
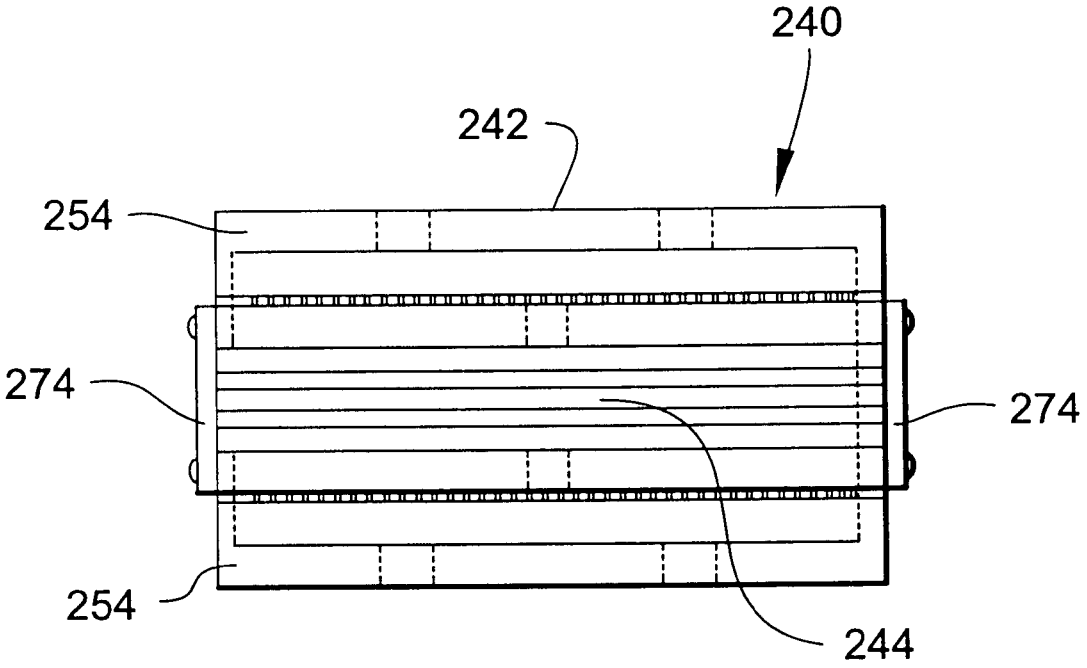
FIG. 7 is an elevation view of the inlet opening of the housing.

The air opening jet 240 of the present invention includes a housing 242 that is formed, at one of its ends, with an inlet opening 244. As best seen in FIG. 7, the inlet opening 244 has a generally rectangular configuration that corresponds generally to the shape of the partially opened tow 14 which is received in the inlet opening 244 as described above. The housing 242 also includes an outlet opening 246 which, as best seen in FIG. 5, also has a rectangular configuration that corresponds to the desired shape of the tow leaving the air opening jet apparatus 240.

Figure 3:
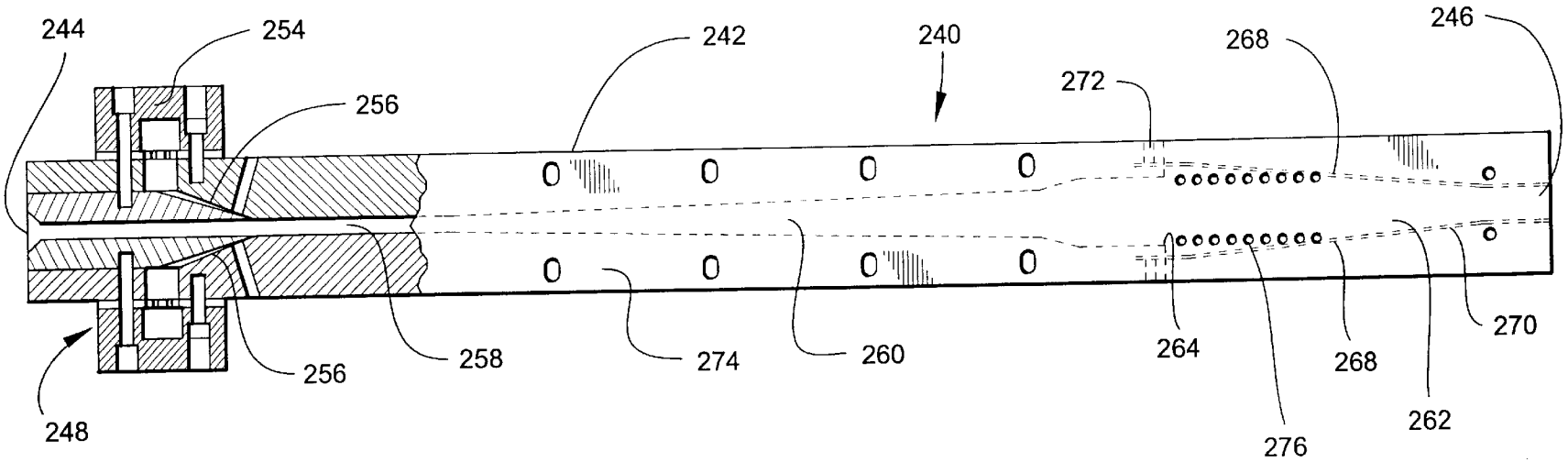
FIG. 3 is a side elevational view, partially in section, illustrating the air opening jet illustrated in FIG. 2.

An air jet, generally indicated by the reference numeral 248, is formed adjacent the inlet end of the housing 242, and it includes a source of compressed air 250 and a conventional control valve 252 for regulating the flow of compressed air from the compressed air source 250 to an air manifold, 254 through which the compressed air is delivered to jet orifices 256 which form a conventional jet of air for moving the tow 14 through a central passageway 258 in the housing 242 as will be explained in greater detail presently. As best seen in FIG. 3, the passageway 258 has a gradually increasing cross-sectional area in the direction of movement of the tow 14 so as to provide a forming chamber 260 downstream of the air jet 248, and this forming chamber 260 also preferably has a generally rectangular configuration that corresponds to the rectangular shape of the tow 14.

An accumulating chamber 262 is located adjacent the outlet end of the housing 242 and downstream of the forming chamber 260, and the accumulating chamber 262 has a vertical dimension which is greater than the outlet opening 264 of the forming chamber 260, and it also is preferably formed with a rectangular configuration that will permit the opened tow 14 passing into the accumulating chamber 262 from the forming chamber 260 to accumulate within the accumulating chamber 262 and ultimately be withdrawn from the housing 242 through the outlet opening 246 at different flow rates and in the preferred rectangular shape of the tow 14.

Figure 4:
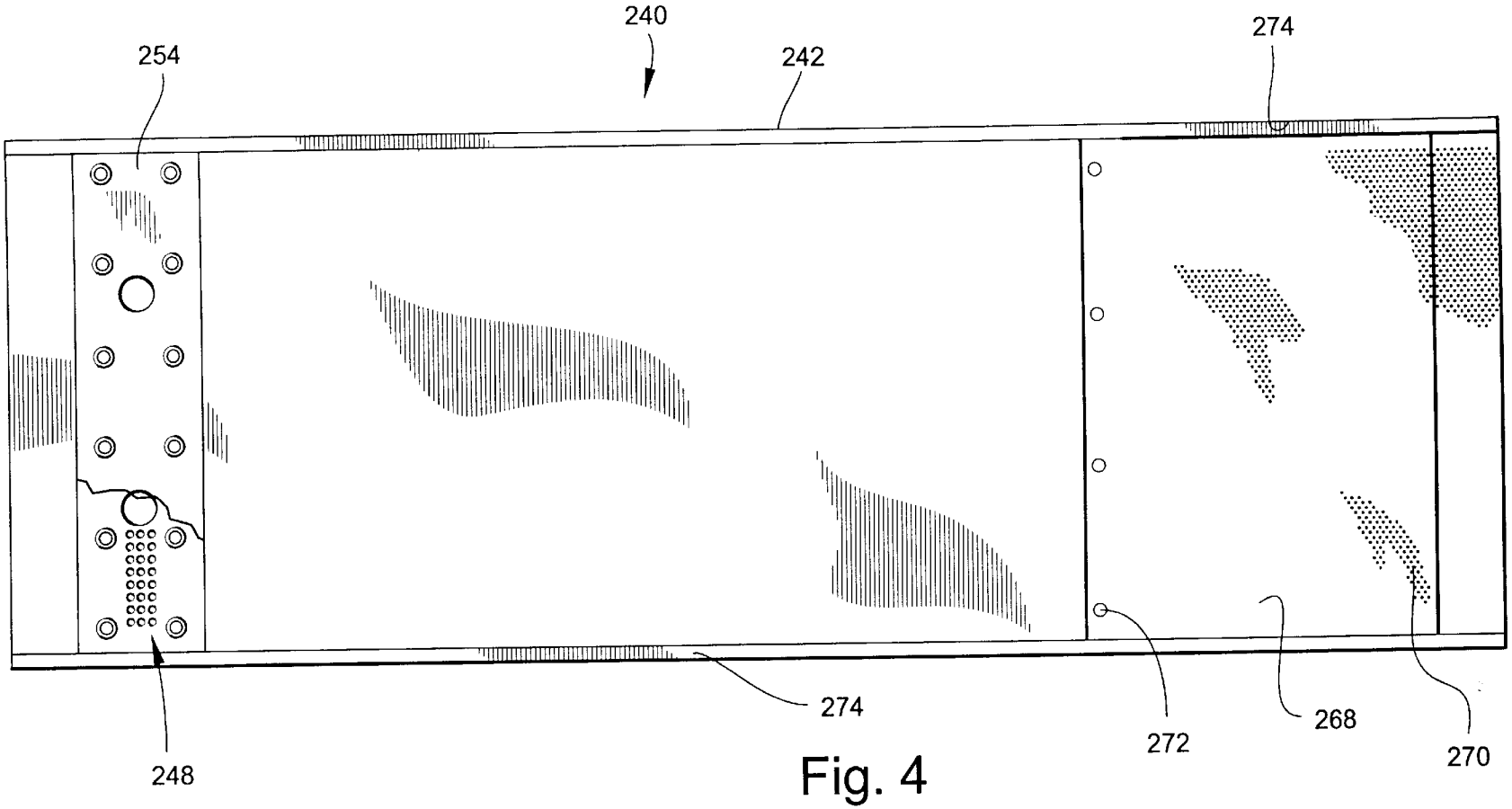
FIG. 4 is a plan view of the housing of the air opening jet illustrated in FIG. 2.

As best seen in FIGS. 3 and 4, a pair of plates 268, each having a large number of perforations 270 therein, are disposed in the accumulating chamber 262 and in the path of the tow 14 as it exits the forming chamber 260 and enters the accumulating chamber 262. The plates 268 are fixed in place within the accumulating chamber 262 by a plurality of bolts 272 that maintain the plates 268 in fixed positions within the accumulating chamber 262.

The housing 242 also includes a pair of side plates 274 which extend along both sides thereof (see FIG. 7) to enclose the sides of the accumulating chamber 262 and the forming chamber 260, and each of the side plates 274 is formed with a plurality of perforations 276 which are located generally at a position where the carrier air leaves the forming chamber 260 and enters the accumulating chamber 262, whereby some of the carrier air can be discharged through the perforations 276.

In operation of the air opening jet apparatus 240, compressed air from the compressed air source 250 flows to the air jet 248 at a flow rate controlled by the control valve 252, and the jet of air formed by the orifices 256 will move the tow 14 through the forming chamber 260. As the tow 14 is moved through the forming chamber 260 by the carrier air, the carrier air will partially open and expand the tow 14 so that it gradually increases in cross-sectional area in conformity with the gradually increasing cross-sectional area of the forming chamber 260. When the tow exits the forming chamber 260 and enters the accumulating chamber 262, it first opens even further to correspond to the vertical distance between the upstream ends of the perforated plates 268 (see FIG. 3), and the tow 14 engages the inner surfaces of the perforated plates 268 which are disposed in the path of the tow 14.

While some of the carrier air may be discharged through the perforations 276 in the side plates 274, a substantial portion of the carrier air moves the tow 14 through the spacing between the perforated plates 268 and passes outwardly through the perforations 270 in the plates 268. In so doing, the air passing outwardly through the perforations 270 urges the tow 14 into frictional engagement with the facing inner surfaces of the perforated plates 268, and this frictional engagement creates a braking action on the tow 14 which retards the movement of the tow 14 through the accumulating chamber 262 and causes the tow to density and accumulate in the accumulating chamber 262 at a density greater than it had in the forming chamber 260, after which the opened and now densified tow 14 exits the accumulating chamber 262 through the outlet opening 246 at different flow rates.

It is important that the tow 14 which exits through the outlet opening 246 has a desired and uniform density throughout the generally rectangular shape of the tow 14, and the present invention provides a unique and very desirable method of properly controlling the density of the exiting tow 14. More specifically, it will be apparent that the flow rate of the carrier air will determine the retarding or braking action applied to the tow 14 as it passes between the perforated plates 268. If the flow rate of the carrier air is increased, the carrier air passing outwardly through the perforations 270 in the plates 268 will urge the tow 14 into engagement with the plates 268 with a greater force, and will thereby increase the retarding or braking action that is applied to the tow 14. Conversely, if the flow rate of the carrier air is decreased, there will be a smaller braking action applied to the tow 14.

Therefore, virtually infinite regulation of the braking action is obtained in the present invention by the simple expedient of operating the control valve 252 to provide a flow of carrier air that will provide the desired braking action imposed on the tow 14, and thereby control the density of the tow 14 as it leaves the housing 242.

Although it will be appreciated that the actual flow rate of the carrier air will vary from application to application depending on a number of factors, it has been found in operation of a prototype of the present invention that an air pressure of about 40 psi provides a desirable density of the tow 14 consisting of 0.004 grams/cm$^3$ exiting through an outlet opening having a width of 20 centimeters and a height of 2.5 centimeters.

It will, therefore, be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An air opening jet apparatus for use in a system for opening a thin, relatively wide tow of textile filaments held together by crimping and forming the opened tow into a predetermined shape suitable for use as an absorbent structure for personal care products, comprising:

(a) a housing having an inlet opening for receiving a partially opened tow and having a configuration corresponding generally to the shape of the partially opened tow, and having an outlet opening through which said tow exits said housing and having a configuration corresponding generally to said predetermined shape;

(b) an air jet formed within the housing adjacent said inlet opening thereof to create a venturi which moves the tow through the air opening jet apparatus and which also further opens the tow;

(c) a source of compressed air communicating with said airjet to provide carrier air for moving said tow through said jet apparatus;

(d) a forming chamber within the housing and downstream of the air jet that includes a gradually increasing cross-sectional area in the direction of flow of the tow that corresponds to said predetermined shape, said air jet being disposed within said housing to cause said tow to be fully opened and to substantially fill said forming chamber as it moves therethrough;

(e) an accumulating chamber located within said housing downstream of said forming chamber that is constructed and arranged to permit said opened tow to accumulate within the accumulating chamber and be withdrawn from said housing at different flow rates through said housing outlet opening in said predetermined shape, said accumulating chamber including at least one perforated plate disposed in the path of said tow and said carrier air moving therethrough to cause said tow to engage said perforated plate and to cause at least some of said carrier air to pass through said perforated plate; and (f) a control valve for maintaining the flow of said carrier air at a level that will cause at least said portion of said carrier air to pass through said perforated plate and urge said tow into frictional engagement with said perforated plate with sufficient force to retard the movement of the tow through said accumulating chamber and cause said tow to accumulate in said accumulating chamber.

2. An air opening jet apparatus as defined in claim 1, wherein said accumulating chamber includes a second perforated plate located in spaced relation to said at least one perforated plate, and wherein said tow moves between said perforated plates and is urged into engagement therewith by said carrier air passing through both said perforated plates.

3. An air opening jet apparatus as defined in claim 1, wherein said shape of said outlet opening in said housing is rectangular.

4. An air opening jet apparatus for opening a thin, relatively wide tow of textile filaments and forming the opened tow into a predetermined shape comprising:

(a) a housing having an inlet opening for receiving a partially opened tow and an outlet opening through which said tow exits said housing;

(b) an air jet formed within the housing adjacent said inlet opening thereof to create a venturi which moves the tow through the air opening jet apparatus and which also further opens the tow;

(c) a source of compressed air communicating with said air jet to provide carrier air for moving said tow through said jet apparatus;

(d) a forming chamber within the housing and downstream of the air jet that includes a gradually increasing cross-sectional area in the direction of flow of the tow, said air jet being disposed within said housing to cause said tow to be substantially fully opened as it moves therethrough;

(e) an accumulating chamber located within said housing downstream of said forming chamber that is constructed and arranged to permit said opened tow to accumulate within the accumulating chamber and be withdrawn from said housing at different flow rates through said housing outlet opening, said accumulating chamber including at least one perforated plate disposed in the path of said tow and said carrier air moving therethrough to cause said tow to engage said perforated plate and to cause at least some of said carrier air to pass through said perforated plate; and (f) a control valve for maintaining the flow of said carrier air at a level that will cause at least said portion of said carrier air to pass through said perforated plate and urge said tow into functional engagement with said perforated plate with sufficient force to retard the movement of the tow through said accumulating chamber and cause said tow to accumulate in said accumulating chamber at a greater density than it has in said forming chamber.

5. A method of opening a thin, relatively wide tow of textile filaments and forming the opened tow into a predetermined shape, said method comprising the steps of:

(a) creating a jet of carrier air for moving the tow through a housing from an inlet opening to an outlet opening;

(b) moving said tow through a forming chamber within said housing having a gradually increasing cross-sectional area in the direction of flow of the tow to partially open the tow;

(c) moving the tow into an accumulating chamber downstream of said forming chamber while causing said tow to engage at least one perforated plate positioned in the path of said tow and causing at least a portion of said carrier air to flow outwardly through said perforated plate; and (d) regulating the flow of said carrier air to cause the carrier air to urge the tow into frictional engagement with said perforated plate with sufficient force to retard the movement of the tow through the accumulating chamber and cause the tow to accumulate within said accumulating chamber at a greater density than it has in said forming chamber.

* * * * *